United States Patent [19]

McCabe

[11] 4,004,480

[45] Jan. 25, 1977

[54] PRESS

[76] Inventor: Francis J. McCabe, 239 Hastings Court, Doylestown, Pa. 18901

[22] Filed: Jan. 21, 1976

[21] Appl. No.: 650,926

[52] U.S. Cl. ..... 83/530; 83/604; 83/606; 83/634; 83/639; 100/272

[51] Int. Cl.[2] ..... B26D 5/12

[58] Field of Search ..... 83/527, 529, 530, 601, 83/604, 606, 630, 634; 100/270, 272

[56] References Cited

UNITED STATES PATENTS

| | | | |
|---|---|---|---|
| 3,196,727 | 7/1965 | Pray | 83/601 |
| 3,690,207 | 9/1972 | McCabe | 83/627 |

*Primary Examiner*—Willie G. Abercrombie
*Attorney, Agent, or Firm*—Frank J. Benasutti Assoc., Ltd.

[57] ABSTRACT

A fluid piston actuated press is provided with a lever arm having multiple bearing means for transmitting and amplifying the force exerted by a piston to the movable parts of the press and work piece. A novel fulcrum bearing is provided which ensures that frictionally induced shearing forces are counteracted. This is achieved by allowing the bearing to reciprocate along an axis which is acute with respect to the stroke axis. Additional means are provided to adjust the degree of amplification and stroke of the movable part without altering the stroke of the fluid piston. A novel arrangement of component parts is described which allows easy accessibility to the work area and great flexibility of application. An alternate embodiment of the present invention further describes a multiple piston actuated press provided with a plurality of lever arms and bearing means for transmitting and amplifying the forces exerted by said pistons to movable parts of the press, which parts are mounted to reciprocate along transverse axes.

13 Claims, 5 Drawing Figures

PRESS

BACKGROUND OF THE INVENTION

This invention relates to presses, and more particularly, to pneumatic presses. In the prior art, presses actuated by various means, including pneumatic pistons and cylinders, utilize punch and die sets to perform work on a work piece. Pneumatically actuated presses are generally used for light duty work. It is desirable to use pneumatic presses in other than light duty work, but the known pneumatic systems are limited in capacity. Some examples of prior art presses are illustrated in U.S. Pat. Nos. 1,038,934, 1,488,562, 2,241,794, and 3,230,812.

More recently, I have developed a fluid piston actuated press which has overcome many of the disadvantages of prior art fluid piston actuated presses. This press is described in U.S. Patent No. 3,690,207, which issued on Sept. 12, 1972.

SUMMARY OF THE INVENTION

I have invented a new means for transmitting pneumatic power from a pneumatic piston and cylinder to the operating parts of a press. This new means generally comprises a lever means in which a novel fulcrum bearing is provided which is designed to reciprocate along an axis which acutely intersects the axis which is travelled by the punch portion of the press. By inclining the axis of travel of this novel fulcrum bearing means with respect to the stroke path, frictional forces which would otherwise be exerted on the punch to create a shearing action are eliminated, thereby ensuring that, in practice, those forces actually applied to the punch portion of the press are coincident with its path of travel.

A primary object of the present invention is, therefore, the elimination of any shearing forces created by friction within the amplification means of a press. Another object of the present invention is the provision of a compact press which provides easy accessibility to the working area. Another aim of the present invention is the provision of a press utilizing a fixed stroke pneumatic piston which is easily adjustable to a variety of forces and strokes. Another object of the present invention is the provision of the multiple piston press in which movable punch portions reciprocate transversely with respect to each other.

These and other objects of the present invention will become apparent from the following description with reference to the accompanying drawings.

DESCRIPTION OF THE PREFERRED EMBODIMENTS

Figure 1:
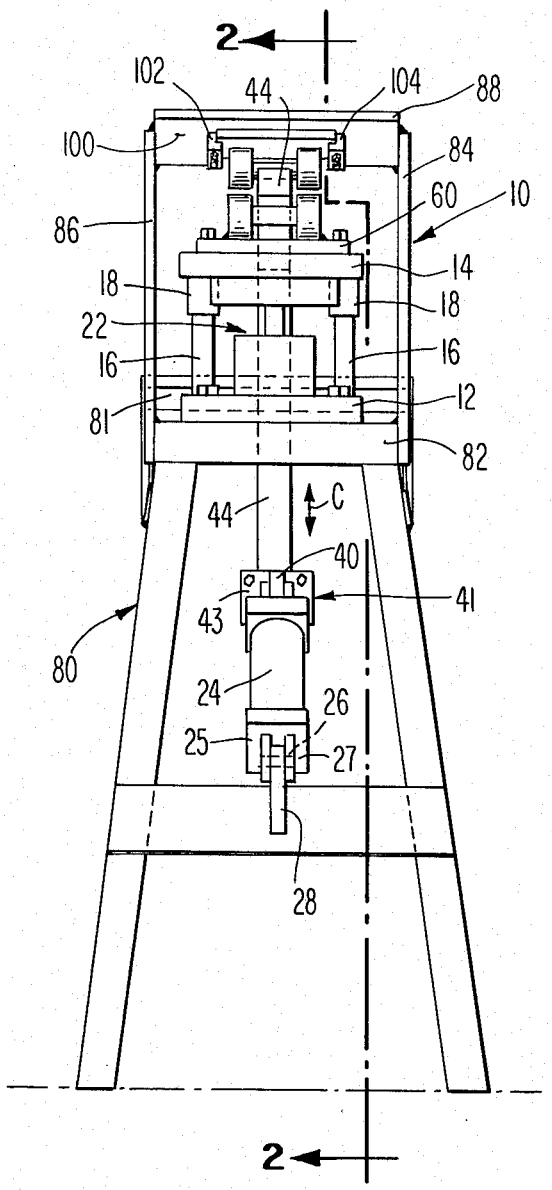
FIG. 1 is a front elevation of a pneumatic press in accordance with the preferred embodiment of my invention.

Although specific forms of the invention have been selected for illustration in the drawings, the following description is drawn in specific terms for the purpose of describing these forms of the invention, this description is not intended to limit the scope of the invention which is defined in the appended claims.

Figure 2:
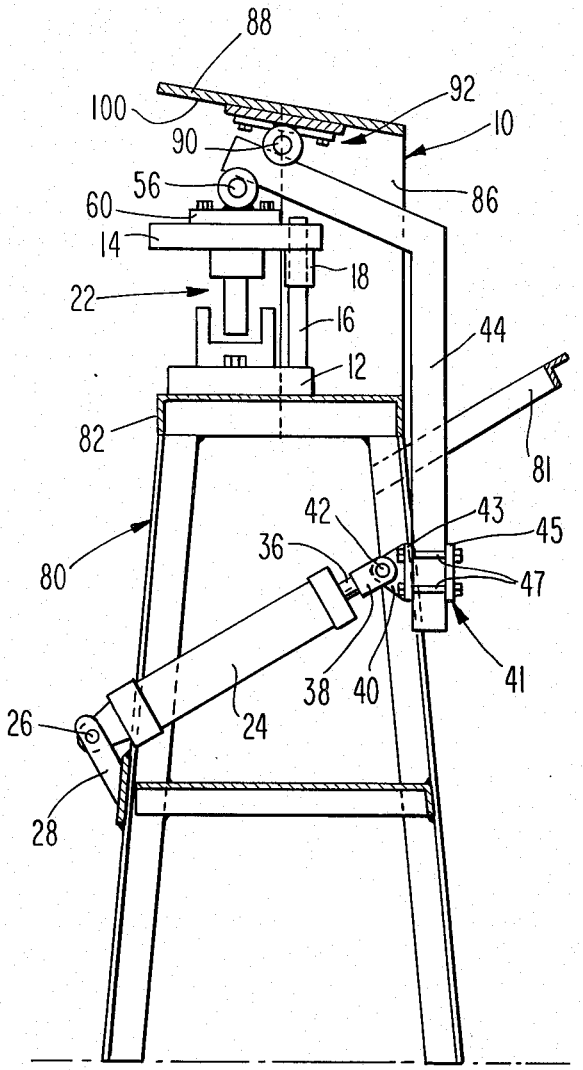
FIG. 2 is a section taken as indicated by the lines and arrows 2—2 in FIG. 1, showing a portion of the apparatus partially broken away.

Referring to the figures, FIGS. 1 and 2 show a preferred embodiment of the present invention wherein cylinder 24 is mounted under the punch and die set designated generally 22 with an open area defined by stand designated generally 80. The frame 10 of the press is deemed to generally comprise this stand, designated generally 80, on which is disposed mounting plate 82 which, in FIG. 2, is shown to have a U-shaped cross section. Supporting plates 84 and 86 extend generally perpendicularly away from mounting plate 82 to support fulcrum plate 88, which is a substantially planar plate disposed in a plane which forms an acute angle with respect to the face of mounting plate 82. The purpose and precise nature of this angular mounting of the fulcrum plate 88 will be discussed more fully hereinafter. As seen particularly in FIG. 1, the fulcrum plate 88 has a smooth planar undersurface 100, the function of which will also be more fully explained hereinafter. The stand 80 and the frame 10 are constructed from conventional materials of sufficient strength to withstand the forces exerted upon them during the operation of the press.

As seen in FIGS. 1 and 2, a base portion 12 is rigidly mounted on the mounting plate 82 and a movable portion 14 cooperates with guide means 16 and 18 which cooperate therewith in guiding the movable member 14 towards the fixed base member 12 and in returning the movable member to its original position. Between the fixed and movable members, a punch and die set designated generally 22 is mounted. The specifics of this die set are not illustrated in further detail herein since they are well known in the art and form no part of this invention.

The actuating means for the press is a double acting pneumatic piston and cylinder arrangement comprising a cylinder 24 pivotally mounted at one end to a portion of the stand designated generally 80 by any suitable means such as a shaft 26 fixedly attached thereto and passing through cylinder flanges 25 and 27 and anchor member 28 which is rigidly affixed to the stand designated generally 80. Connected to the piston (not shown) within the cylinder and extending therefrom is piston rod 36. The rod terminates in a yoke 38 which is pivotally connected to the ear 40 by the shaft 42 passing therethrough. The piston, cylinder and piston rod arrangement forming the pneumatic means are well known in the art, and upon appropriate air input function to drive the piston rod and extend or retract it with respect to the cylinder.

Together, ear 40, ear mounting plate 43, compression plate 45 and bolts 47 comprise the adjustable bracket means designated generally 41 of the present invention. When the bolts 47 are loosened the remainder of the adjustable bracket means may be slid along lever arm 44 to vary the point on that lever arm at which the force from cylinder 24 is applied. This adjustable path of travel of the bracket means designated generally 41 is illustrated by arrow C shown in FIG. 1 by moving the bracket means relatively closer to the middle of the lever arm 44, the length of stroke of the movable upper portion 14 is increased while the power of that stroke is proportionally decreased. Similarly, as the adjustable bracket means designated generally 41 is fastened relatively near the end of lever arm 44, the length of stroke of the upper movable portion 14 will be decreased with proportional increase in the power of that stroke. As a result, a pneumatic cylinder having a fixed stroke of fixed power is easily adapted to power a press wherein the power and length of stroke is easily adjusted.

Figure 3:
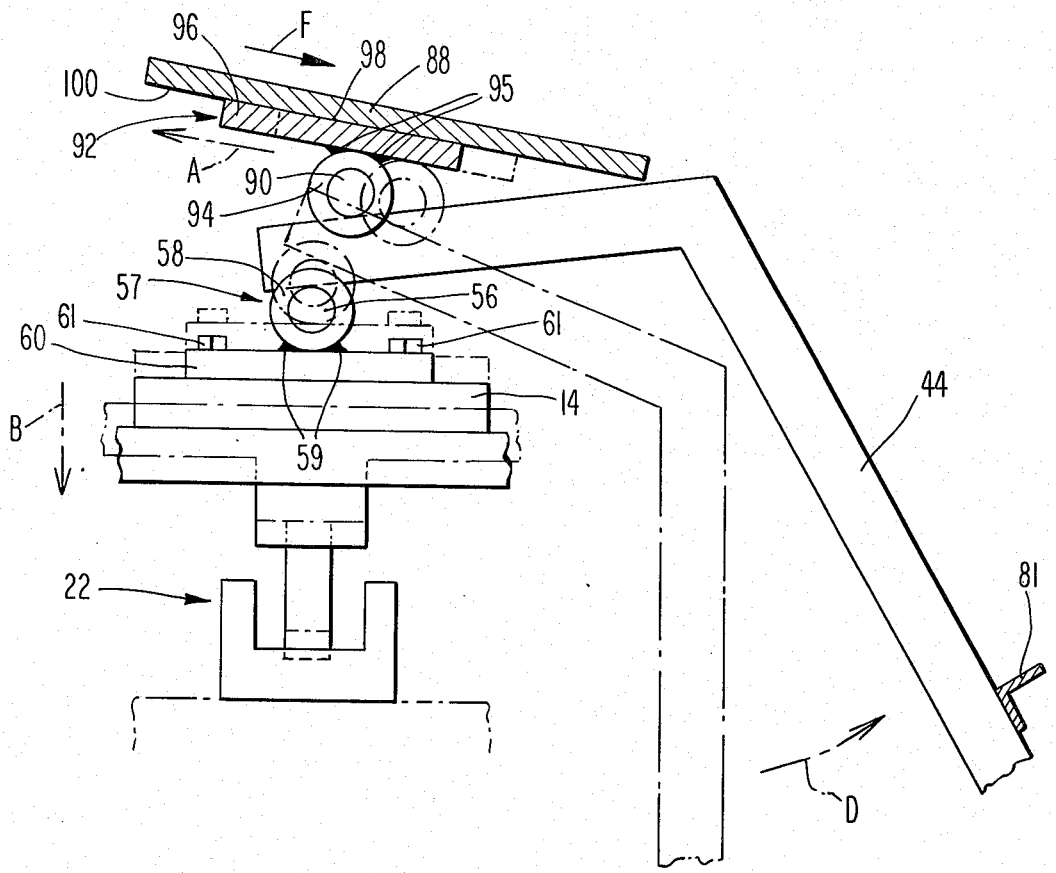
FIG. 3 is an enlarged view of a portion of the apparatus shown in FIG. 2 with alternate positions shown in phantom.

Referring now to FIG. 3, which is an enlarged side view of a portion of the press shown in FIG. 2, the upper movable portion 14 is shown in combination with its associated punch and die set designated generally 22. During activation of the press the desired power stroke of the upper movable portion 14 and its associated punch is along an axis as illustrated by arrow B in FIG. 3. Theoretically, a lever without any bearing means whatsoever could be used in order to produce a suitable power stroke. In actuality, however, upon the activation of a lever to produce the power stroke of the movable portion of a press, frictional forces are created which lend to that movable portion a shearing component, that is to say, a force is applied upon the movable portion of the press which has a vector component which is transverse to the power stroke vector component of that force. As illustrated in FIG. 3, however, applicant's invention counteracts shearing forces by supplying a means to counter-act and thereby neutralize the shearing force. This means for counteracting the frictionally induced shearing forces may be best described in connection with the operation of the press shown in FIG. 3. Upon activation of the pneumatic cylinder (not shown in FIG. 3) lever arm 44 is caused to move from its position as shown in phantom in FIG. 3 along an arc as illustrated by arrow D in FIG. 3 until either the stop bracket prevents further movement or until the cylinder shaft is fully extended. Stop bracket 81 is adjustable with respect to frame 80 not only to provide a means for adjusting the power stroke of the press by varying the degree of arc D shown in FIG. 3, but also for the purpose of allowing the stop bracket 81 to be oriented to intersect the power stroke axis of piston rod 36. By adjusting the stop bracket 81 to intersect with the power stroke axis of piston rod 36, the force applied by cylinder 24 may be limited without created additional torques which might otherwise be translated to the punch and die assembly designated generally 22. The thrust bearing member designated generally 57 is shown in FIG. 3 to move along an axis parallel to the axis defined by arrow B in FIG. 3 from the phantom to the lined position shown in FIG. 3. During its advancement thrust bearing surface 56, which is welded to lever arm 44, rotates within the thrust cradle 58. This thrust cradle is a substantially tubular member which concentrically engages the thrust bearing surface 56. A portion of the thrust cradle member 58 is cut away along its upper surface as seen in FIG. 3 to enable interconnection between the thrust bearing member 56 and the lever arm 44 and to further facilitate rotation of the thrust bearing surface within the thrust cradle member. The thrust cradle member 58 is welded by weld 59 to thrust block 60, which is a substantially planar plate which is bolted by bolts 61 to the upper movable member 14. As a result, the thrust bearing means designated generally 57 is seen to pivotally connect the lever arm 44 with the upper movable portion 14 so that the thrust of lever arm 44 is transferred thereto.

A fulcrum bearing surface 90 is shown in FIG. 3 welded to lever arm 44. This bearing surface comprises a shaft which is encircled on its ends by fulcrum cradle means 44 which is substantially tubular with the exception of a suitable portion which is cut away to allow the interconnection between the fulcrum bearing surface 90 and lever arm 44. The fulcrum cradle means 94 is welded to fulcrum block 96 by welds 95. The fulcrum block 96 is a substantially planar plate having a flat surface 98 thereon which engages the flat undersurface 100 of fulcrum plate 88. Fulcrum block 96 is allowed to slide along the undersurface 100 of the fulcrum plate in an axis which is defined by tracks 102 and 104 as seen in FIGS. 1 and 2. Upon activation of the pneumatic cylinder to cause the lever arm 44 to move from the phantom to the line position in FIG. 3, the fulcrum bearing means designated generally 92 for engaging the bearing surface allows the bearing surface 90 to rotate within the fulcrum cradle 94 and further allows the fulcrum bearing surface 90 to move along an axis as indicated by arrow A in FIG. 3. Normally, the movement of fulcrum block 96 across fulcrum plate 88 would give rise to a frictional force which can be conceptualized as a force resulting from the resistance of the plate to the block which is illustrated by arrow F in FIG. 3. By slightly tilting the fulcrum plate 88 and the fulcrum block 96 to an acute angle with respect to the axis of arrow B in FIG. 3, a vector component is created, tending to force the block in the direction along axis A as indicated in FIG. 3, which vector component has the effect of cancelling the frictional force F as shown in FIG. 3. As a result, the only remaining force is a force having a vector component parallel to axis B as indicated in FIG. 3, and the result is a punching action in which the shearing forces are minimized or eliminated.

The degree of tilt which is necessary in order to effectively counteract the shearing forces which are frictionally induced will, of course, vary in accordance with the severity of the frictional forces which are inherent in any particular machine construction. Under normal conditions, applicant has found that in most applications an acute angle of more than 70 and less than 90 degrees is sufficient to effectively counteract these frictionally induced shearing forces. More particularly, for a device as shown in FIGS. 1–3, applicant has found that an acute angle between 80° and 85° is preferred to counteract these frictionally induced shearing forces. As used herein, the acute angle which is referred to throughout the specification and claims is that angle which is formed between the axis of reciprocation of the thrust bearing means designated generally 57 in FIG. 3 and the axis of reciprocation of the fulcrum bearing means designated generally 92 in FIG. 3, which angle is generally located between the fulcrum bearing surface 90 and the thrust bearing member designated generally 57.

Figure 4:
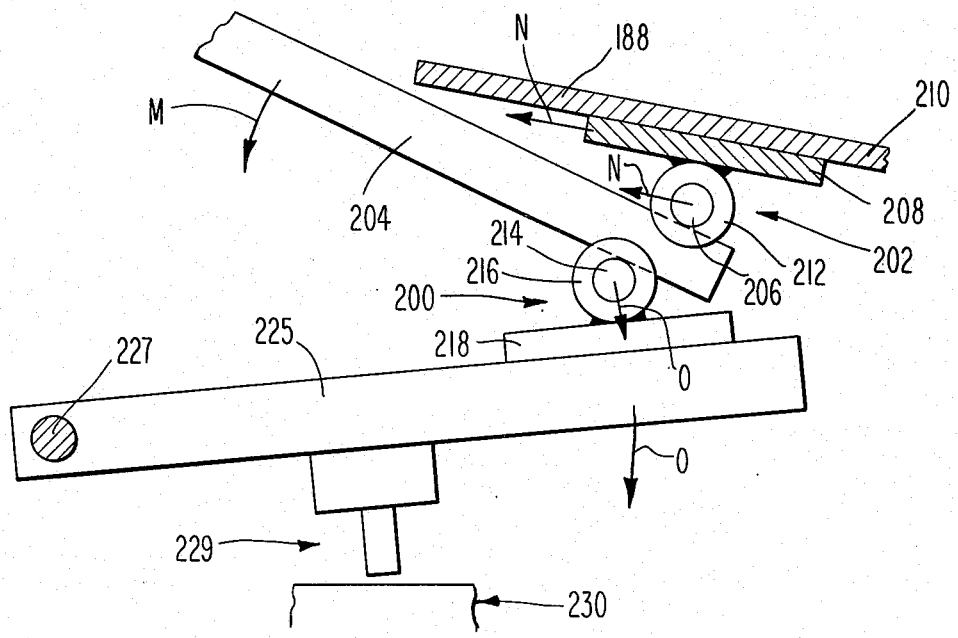
FIG. 4 is an enlarged view of an alternate embodiment of the present invention illustrated in the form of a compound press.

Referring now to FIG. 4, which shows an alternate embodiment of the present invention in the form of a compound press, the invention is illustrated in a form wherein the thrust bearing means designated generally 200 is located intermediate along the lever arm 204 with respect to the fulcrum bearing means designated generally 202. Upon activation of the lever means 204 along an arc designated M in FIG. 4, the fulcrum bearing means for engaging fulcrum bearing surface 206 will slide generally to the left as seen in FIG. 4 along an arrow designated N in FIG. 4, as described above. The fulcrum block 208 will slide along fulcrum plate 210 while bearing surface 206 rotates within the fulcrum cradle means 212. The thrust bearing means will similarly be driven in a direction as indicated by the arrow O in FIG. 4 while the thrust bearing surface 214 rotates within thrust cradles means 216, which is welded to thrust block 218. As illustrated in FIG. 4, the movement of the thrust bearing means designated generally 200 is used to apply force to a second lever arm 225 which is mounted on a pivot 227 to more punch 229 towards a die 230.

Figure 5:
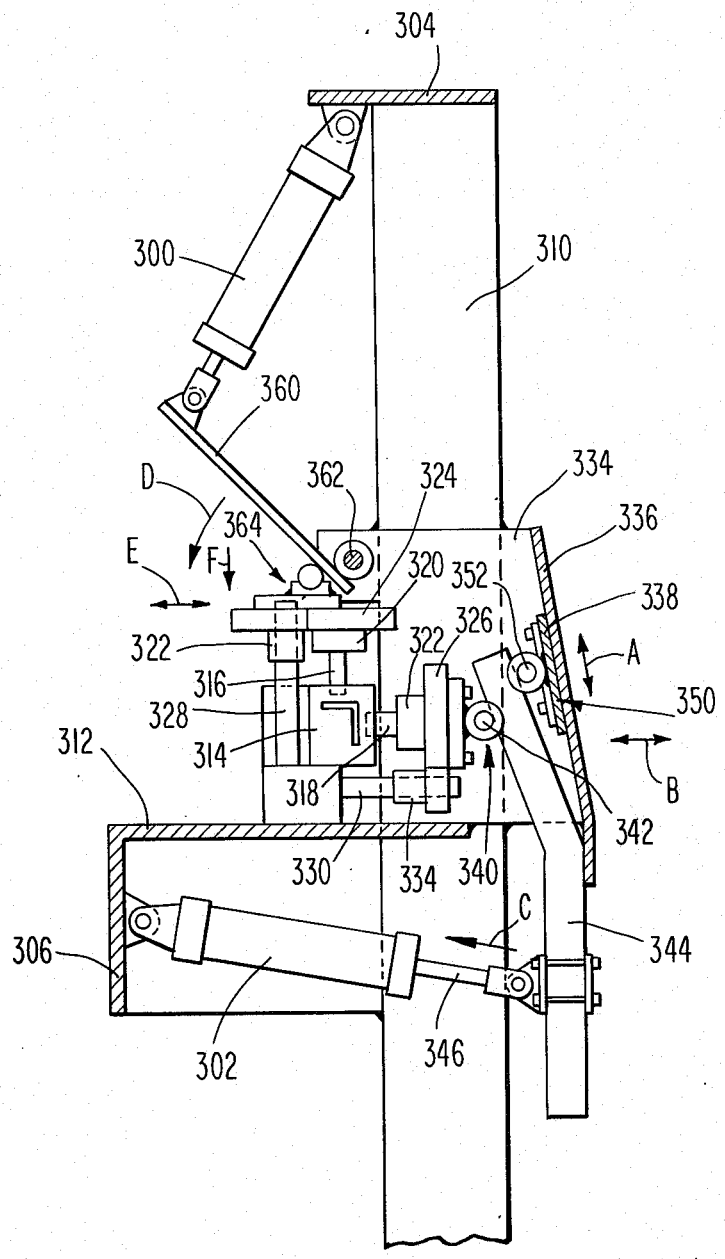
FIG. 5 is an enlarged side elevation of a second alternate embodiment press constructed in accordance with the present invention.

Referring now to FIG. 5, a press is shown in which two actuating cylinders 300 and 302 are mounted on mounting plates 304 and 306 respectively. These mounting plates are welded or otherwise attached to frame 310 and mounting plate 312 respectively. On mounting plate 312 is disposed a die 314 which is adapted to receive two punches 316 and 318 which act along axes which are substantially transverse to each other. These punches are mounted on suitable punch support 320 and 322 which are in turn mounted on first and second movable portions 324 and 326. Guide rods 328 and 330 are journalled within bushings 332 and 334 to guide punches 316 and 318 along the desired axes. A substantially planar plate 334 is welded to frame 310 and coacts with a symmetrically disposed planar plate (not shown) to support fulcrum plate 336. As in the embodiments illustrated in FIGS. 1–4, the fulcrum plate 336 and fulcrum block 338 form an acute angle with respect to the axis of travel of punch 318 which angle is on the order of more than 70° and less than 90°, and preferably is between 80° and 85°, as measured by the smallest angle formed between the intersection of axes parallel to A and B as indicated in FIG. 5. As in the other embodiments, thrust bearing means designated generally 340 engages bearing surface 342, which is rigidly attached to lever arm 344 and which rotates within thrust bearing means 340. When cylinder 302 is activated to draw a shaft 346 in a direction as indicated by arrow C in FIG. 5, fulcrum bearing means designated generally 350 allows fulcrum bearing surface 352 which is welded to lever arm 344 to rotate within the fulcrum cradle and further causes the fulcrum bearing means designated generally 350 to move along an axis as indicated by arrow A in FIG. 5. As a result, frictionally induced shearing forces are counteracted so that only forces parallel to the axis indicated by arrow B in FIG. 5 are applied to punch 318. The second force amplification means shown in the embodiment of FIG. 5 is a pneumatic actuated lever amplification means similar to that described in my previously issued U.S. Pat No. 3,690,207, wherein the thrust F from punch 316 is produced by actuation of cylinder 300 to cause lever 360 to move along an arc as designated by arrow D in FIG. 5. A fixed pivot 362 is rigidly attached to lever arm 360 while thrust bearing means designated generally 364 reciprocates along an axis E as designated in FIG. 5 along the upper surface of upper movable portion 324.

As a result, a press is provided which is extremely compact and which could, within the spirit of the present invention, incorporate further movable portions disposed along other intersecting axes for the purpose of sequentially forming extremely complex pieces. It will be noted, for example, that the particular design illustrated in FIG. 5 disposes both lever arm and cylinders within a single plane for action upon die 314. Subsequent modification, depending on the die, could easily substitute additional cylinders and lever arms to act on die 314 within a plane transverse to the plane of the paper. Applicant believes that this compactness and flexibility has never been achieved in the prior art and facilitates a variety of punch and die operations which are not feasibly using other prior art presses.

It will be understood that various changes in the details, materials and arrangement of parts which have been herein described and illustrated in order to explain the nature of this invention may be made by those skilled in the art within the principle and scope of the invention as expressed in the following claims.

It will further be understood that the "Abstract of the Disclosure" set forth above is intended to provide a non-legal technical statement of the contents of the disclosure in compliance with the Rules of Practice of the United States Patent and Trademark Office, and is not intended to limit the scope of the invention described and claimed herein.

What is claimed is:

1. In a press having a fixed portion, a movable portion which moves along a preselected path of travel with respect to said fixed portion, and actuating means for transmitting force to said movable portion, an improved force amplification means comprising:

a. lever means pivotally attached to said movable portion;

b. fulcrum bearing surface means connected to said lever means for movement therewith; and c. fulcrum bearing means for engaging said bearing surface means, said fulcrum bearing means comprising:

i. fulcrum cradle means for allowing said bearing surface means to rotate, and ii. fulcrum bearing track means for allowing said bearing surface to reciprocate along an axis which intersects said preselected path of travel.

2. The invention of claim 1 wherein said second axis intersects said first axis in an acute angle.

3. The invention of claim 2 wherein said acute angle is more than 70° and less than 90°.

4. The invention of claim 3 wherein said acute angle is between 80° and 85°.

5. The invention of claim 1 wherein said press further comprises thrust bearing means for pivotally connecting said lever means and said movable portion.

6. The invention of claim 1 wherein said fulcrum cradle means encircles at least a portion of said bearing surface means.

7. The invention of claim 1 wherein said fulcrum bearing track means comprises a fulcrum block and a fulcrum plate, said block and plate having complemental bearing surfaces disposed thereon to allow said block to slide along said plate.

8. The invention of claim 7 wherein said fulcrum cradle means is fixedly attached to said block.

9. The invention of claim 5 wherein said fulcrum bearing means and said thrust bearing means each comprise a cylindrical shaft welded to said lever means, a substantially tubular cradle member which encircles at least a portion of said shaft, and a substantially planar block welded to said cradle member.

10. The invention of claim 1 wherein said movable portion comprises a lever.

11. The invention of claim 1 wherein said lever means is pivotally attached to said actuating means by an adjustable bracket means, said bracket means being adapted to engage said lever means at any of a variety of points along its length to thereby vary the length and power of the stroke of said movable portion in response thereto.

12. A press, comprising:

a. a single fixed die portion;

b. a plurality of movable portions mounted for movement along a plurality of paths;

c. a plurality of actuating means, one for each movable portion, for transmitting force to each movable portion; and d. a plurality of force amplification means, one for each movable portion, for amplifying the force applied by said actuating means to said movable portions, each of said force amplification means comprising, i. a lever pivotally attached to said actuating means, ii. a bearing surface attached to said lever for movement therewith, and iii. bearing means engaging said bearing surface for allowing said bearing surface to reciprocate along an axis which intersects the path of its associated movable portion.

13. The invention of claim 12 wherein said paths intersect within said fixed die portion.

* * * * *